US006244156B1

(12) United States Patent
Steuer et al.

(10) Patent No.: US 6,244,156 B1
(45) Date of Patent: Jun. 12, 2001

(54) METHOD OF PROTECTING AN OBJECT FROM THE EFFECT OF A HIGH-SPEED PROJECTILE

(75) Inventors: Raimar Steuer, Leinburg; Christian Klee, Pyrbaum; Helmut Ertel, Hersbruck; Gunter Weihrauch, Blansingen, all of (DE)

(73) Assignee: Diehl Stiftung & Co., Nürnberg (DE)

( * ) Notice: Subject to any disclaimer, the term of this patent is extended or adjusted under 35 U.S.C. 154(b) by 0 days.

(21) Appl. No.: 09/401,034

(22) Filed: Sep. 21, 1999

(30) Foreign Application Priority Data

Oct. 13, 1998 (DE) ..... 198 47 091

(51) Int. Cl.[7] ..... B64D 1/04; F41H 11/00; F42C 13/00; F42B 10/00

(52) U.S. Cl. ..... 89/1.11; 89/36.17; 102/211; 102/473

(58) Field of Search ..... 89/1.11, 36.17; 102/211, 473, 293

(56) References Cited

U.S. PATENT DOCUMENTS 4,215,630 * 8/1980 Hagelberg et al. ..... 89/1.11
5,400,688 3/1995 Eninger et al. ..... 89/1.11
5,464,174 * 11/1995 Laures ..... 244/3.11
5,495,787 * 3/1996 Boyer, III ..... 89/1.11

FOREIGN PATENT DOCUMENTS 27 19 150 C1 3/1987 (DE) .
38 31 329 A1 5/1990 (DE) .
40 08 395 A1 9/1991 (DE) .
41 22 622 A1 1/1993 (DE) .
195 43 489 C1 2/1997 (DE) .

* cited by examiner

*Primary Examiner*—Charles T. Jordan
*Assistant Examiner*—Christian M. Best
(74) *Attorney, Agent, or Firm*—Scully, Scott, Murphy & Presser

(57) ABSTRACT

A blast shell is launched as a defense against an attacking tail fin-stabilized projectile, such as in particular a KE penetrator, from an object which is to be protected. Gas fumes and a reaction pressure blast wave from a fired blast warhead of the shell act principally on the tail region of the attacking projectile and thereby deflect the latter from a trajectory in the attack direction so that the object under attack is either missed or at least is not hit in a head-on direction, thereby reducing the effectiveness of the attacking projectile.

6 Claims, No Drawings

METHOD OF PROTECTING AN OBJECT FROM THE EFFECT OF A HIGH-SPEED PROJECTILE

BACKGROUND OF THE INVENTION

1. Field of the Invention

The invention concerns a method of protecting an object from the effect of a high-speed projectile, in particular an armoured vehicle from the threat of KE fin-stabilised projectiles.

2. Discussion of the Prior Art

As a protective measure in relation to projectiles of that kind, which are also referred to as KE penetrators, it is known for example from DE 41 22 622 A1 for the main armouring of the object to be protected to be additionally covered with a reactive armouring comprising plates which are backed with explosive. Sensor means are used to ascertain which region of the object to be protected is threatened by the oncoming projectile in order to fling a plate from that region towards the projectile and thereby disturb at least the kinematics but generally also the kinetics of the attacker so that even in the event of a hit it still only produces a harmless residual effect because for example the fin-stabilised projectile hits the object to be protected when it is no longer in the proper attitude in the longitudinal direction but at an angle thereto and therefore hits the object laterally without a high level of penetration force.

In the case of the reactive armouring known from DT 977 984 the explosive-accelerated plate is no longer hurled towards the approaching projectile but upon impact thereof is displaced transversely to the impact direction in order to deflect the direction of action.

A disadvantage with reactive armouring which is operative in itself is the high additional loading on the object to be protected, more specifically in static terms due to the mass of the reaction plates and in dynamic terms due to the reaction effect in the event of the explosive-accelerated motion of a plate. In addition, when the objects to be protected are vehicles, there is the disadvantage that for reasons relating to design configuration the propulsion region (tracks or wheels at the front) remains substantially unprotected. That represents a particular risk aspect precisely in the main direction of threat to a fighting vehicle. A further disadvantage is that, once a reaction plate has been triggered off, it leaves behind an unprotected area because such a gap can only be closed again in the base magazine after restoration of the plate holders by installing a new explosive-backed reaction plate.

SUMMARY OF THE INVENTION

The object of the present invention is therefore that of providing protection from high-speed projectiles such as in particular KE penetrators, which makes fewer demands and causes fewer stresses on the object to be protected and which after it has been triggered off can be more easily reactivated again and which in particular exerts an optimum disturbance effect on the attacking projectile.

In accordance with the invention that object is attained in that the rapidly approaching projectile, in particular an inertia projectile which is stabilised by means of tail fins, is deflected out of the attack trajectory or at least pivoted out of the attack direction as a result of transverse force effect behind its centre of gravity; more specifically, by a blast grenade or shell being launched towards the attacking projectile from a launch barrel which can be reloaded without problem, on board the object to be protected, the blast shell having an undirectedly acting and therefore very inexpensive warhead which is fired at the optimum approach time to the attacking projectile in order to liberate a gas fumes and reaction pressure wave towards the projectile to be defended against. That time of effect is the optimum when the blast action takes its effect not principally and in particular not firstly on the front region, but rather on the tail region of the attacking projectile, with its tail cross-section which is enlarged by virtue of the presence of the stabilisation vanes. For, otherwise a deflection effect which already produced in the front region could be reversed again by a transverse loading which is thereupon also applied to the tail region.

DETAILED DESCRIPTION

By virtue of the high relative speed as between the high-speed attacking projectile and the defence blast shell which is launched thereagainst the optimum time of action in accordance with the invention is to be relatively closely limited, more specifically to a time range in the order of magnitude of half a millisecond in the course of the defence shell flying as closely as possible past the attacking projectile. In order to observe that critical effective period of time, the optimum firing command time for the blast warhead is determined from the kinematics of the attacking projectile and the kinematics of the defence shell, having regard to system-induced delay times.

The approach kinematics of the projectile to be defended against are measured in accordance with direction and speed by means of a sensor on board the object to be protected, as is described for example in DE 40 08 395 A1 for determining a reaction plate which is to be activated. That sensor can also detect the movement of the blast shell which is launched from the object towards the projectile in order then in the control computer on board the object to be protected to extrapolate from the two speed vectors the anticipated rendezvous time, that is to say in the course of the flypast, the moment in time of the closest approach, behind the central region of the projectile, of the blast shell to the attacking projectile.

For predicting the rendezvous time however the blast shell itself may also be provided with a (proximity) sensor for measuring the variation in respect of time of the remaining distance to the approaching projectile. That on-board sensor is then desirably connected by way of a command connection in relation to the blast shell, to the control computer on board the object to be protected. A bidirectional data connection of that kind may involve a guide beam section with controlled reflector on board the blast shell, but preferably a control wire or the like electrical conductor for bidirectional information communication, by way of which in any case the firing device of the blast shell remains connected to the control computer on board the object to be protected, until implementation of the firing command.

However firing of the blast warhead is not delayed until the rendezvous time. On the contrary, when the rendezvous time is determined from the motion equations ascertained by the sensor, the firing command time is advanced in relation to the extrapolated rendezvous time. The amount of that advance is determined from various delay components which involve in particular the propagation time of the blast wave over the currently applicable rendezvous distance to the tail region of the projectile to be defended against, plus the firing delay time (that is to say the reaction time between the arrival of the firing command at the shell and detonation of the blast warhead) and also plus the transmission and processing times for the detection of sensor data, the communication thereof to the control computer and processing and transmission thereof as the firing command to the blast shell.

Thus in accordance with the invention the rendezvous time to be expected is extrapolated from the trajectory or approach data ascertained by sensor means, but the firing command for the blast warhead is advanced in relation to that rendezvous time by the sum of system-specific delay times so that the blast effect hits the tail region of the projectile to be defended against, precisely within the only very short effective time window resulting from the high passage speed, and thus the blast effect noticeably diverts the projectile out of its instantaneous approach direction, in spite of only a small amount of explosive being used. As a result the projectile misses its target, or at any event it hits the object which is at risk, not in the longitudinal direction but at most in the transverse direction and thus without a major penetration effect.

To sum up therefore it can be found that, in accordance with the invention, to provide a defence against an attacking tail fin-stabilised projectile such as in particular a KE penetrator, a blast shell is launched towards it from the object to be protected, the blast shell gas cloud and reaction pressure blast wave of the fired blast warhead acting principally on the tail region of the attacking projectile and thereby swinging it out of the attack direction so that the object under attack is missed or is at least not hit in the longitudinal direction. Because only a very short usable action time window exists because of the high passage speed, to provide the optimum blast effect the rendezvous time of the closest approach of the blast shell to the tail of the projectile to be defended against is extrapolated from the approach kinematics which are detected by sensor means, but the blast warhead is operated for firing thereof in advance in relation to that rendezvous time, by system-specific delay times. The system-induced delay times which are to be taken into consideration for the time advance are in particular the signal transmission and processing times between sensors and control computer and control computer and firing device, the firing delay time between arrival of the firing command and firing of the blast warhead and the transit time for the blast wave over the distance which obtains at that time from the blast shell to the tail region of the projectile to be defended against.

What is claimed is:

1. A method of protecting an object against the effect of a high-speed projectile having a tail fin-stabilized guidance structure by the action of a gas fumes and reaction pressure wave from the fired blast warhead of a blast shell which is launched towards the projectile, and to the blast warhead of which blast shell a firing information is transmitted from the object to be protected prior to the rendezvous time, which point in time is extrapolated on board the object to be protected by sensor means from the time characteristics of the mutual approach of the projectile and the blast shell so as to cause the blast warhead to initiate a blast wave adjacent the tail fin-stabilized guidance structure of said high-speed projectile and deflect the projectile from the actual ballistic trajectory thereof.

2. A method according to claim 1 characterised in that the firing information time is in advance of the extrapolated rendezvous time by system-induced delay times, wherein the system-induced delay times include in particular the transit time of the blast wave over the rendezvous distance to the projectile to be defended against, the firing delay time of the blast warhead from arrival of the firing information and sensor, computer and transmission times.

3. A method according to claim 1 or claim 2 characterised in that the advanced rendezvous time is extrapolated by way of sensor on board the object to be protected from the movements of the attacking projectile and the blast shell which is fired theretowards, relative to the object to be protected.

4. A method according to claim 1 or claim 2 characterised in that the advanced rendezvous time is extrapolated by way of a sensor for the approach of the attacking projectile on board the object to be protected and by means of a sensor for the remaining distance from the blast shell to the attacking projectile on board the blast shell.

5. A method according to claim 1 characterised in that bidirectional information transmission occurs between the blast shell and the object to be protected.

6. A method according to claim 5 characterised in that the blast shell remains connected by means of an electrical conductor to the object to be protected until the blast warhead is fired.

* * * * *